US006622330B2

(12) United States Patent
Puig

(10) Patent No.: US 6,622,330 B2
(45) Date of Patent: Sep. 23, 2003

(54) CORKSCREW

(75) Inventor: Ramon Brucart Puig, Sabadell (ES)

(73) Assignee: Companyia Andorrana de Llevataps, S.L., Sant Julia de Loria (ES)

( * ) Notice: Subject to any disclaimer, the term of this patent is extended or adjusted under 35 U.S.C. 154(b) by 0 days.

(21) Appl. No.: 10/144,398

(22) Filed: May 13, 2002

(65) Prior Publication Data

US 2002/0174489 A1 Nov. 28, 2002

Related U.S. Application Data

(63) Continuation-in-part of application No. 09/524,061, filed on Mar. 13, 2000, now abandoned.

(30) Foreign Application Priority Data

Mar. 11, 1999 (ES) ..... 9900506

(51) Int. Cl.[7] ..... B25F 1/00; B67B 7/00

(52) U.S. Cl. ..... 7/155; 7/156; 81/3.29; 81/3.37

(58) Field of Search ..... 81/3.09, 3.36, 81/3.37, 3.29, 3.45, 3.48, DIG. 5; 7/151, 155, 156

(56) References Cited

U.S. PATENT DOCUMENTS

| | | | | | |
|---|---|---|---|---|---|
| 344,566 | A | * | 6/1886 | Cluever | 81/3.29 |
| 5,086,675 | A | * | 2/1992 | Leung et al. | 81/3.29 |
| 5,934,160 | A | * | 8/1999 | Gibson | 81/3.37 |
| 6,073,519 | A | * | 6/2000 | Presa Eguren | 81/3.29 |

* cited by examiner

*Primary Examiner*—D. S. Meislin
(74) *Attorney, Agent, or Firm*—Michael J. Striker

(57) ABSTRACT

A corkscrew has an external tubular body having a mouth forming a support over a bottle, a spiral introducible into a cork when rotating the corkscrew, a support for supporting the spiral, and an actuating unit including a toothing provided on the tubular body, an arm having a lower end engageable with the toothing and a lever pivotably connected with the tubular body and also with an upper end of the arm and turnable toward and away form the tubular body, to provide step-by-step an engagement of the lower end of the arm with the toothing, a disengagement of the lower arm with the toothing, and a subsequent engagement of the lower end of the arm with the toothing at a greater height to impart an ascending movement to the support means and thereby to the spiral for removing the cork.

16 Claims, 3 Drawing Sheets

52
55
53
16
72
71
73
7
74
76
51
32
3
33
42
6
1
14
41
15
11
4
13

CORKSCREW

CROSS-REFERENCE TO A RELATED APPLICATION

This is a continuation-in-part of application Ser. No. 09/524,061, filed Mar. 13, 2000, now abandoned.

BACKGROUND OF THE INVENTION

The present invention relates to corkscrews.

More particularly, it relates to a corkscrew which has an external tubular body provided with a mouth forming the bottle support means, a metallic spiral to be introduced in the cork to pull the corkscrew, support means for the metallic spiral and actuation means to achieve the elevation of the metallic spiral introduced in the cork and the extraction of the cork.

At present, different types of corkscrews are known, having a as a common shape: a foldable metallic spiral fitted on a handle or chassis intended to facilitate its grip and actuation.

In these corkscrews, the metallic spiral is fitted over the central area of the handle. The handle includes a foldable arm at one of its ends, which forms a support over the bottle mouth in order to allow the corkscrew to act like a lever over the metallic spiral during the extraction of the cork.

The arm may have an end support area or several longitudinally separated support areas, which are used selectively in the different stages of cork extraction.

The use of these corkscrews requires the application of a substantial force in order to remove the cork and the use of both hands, one hand to apply the pushing force over the handle and the other hand to keep the extreme arm over the bottle.

SUMMARY OF THE INVENTION

It is therefore an object of the present invention to provide a corkscrew which avoids the disadvantages of the prior art.

More particularly, it is an object of the present invention to provide a corkscrew which permits extraction of corks with a minimum effort and simple operation, and has a reduced size depending only on the length of the metallic spiral.

In keeping with these objects and with others which will become apparent herein after, one feature of present invention resides, briefly stated, in a corkscrew which has a tubular body on which an internal tubular part is housed provided with longitudinal travel capability but without rotation capability, with a metallic spiral fitted on the internal tubular part also with longitudinal travel capability but without rotation capability.

Both the external tubular body and the internal tubular part have some lateral planes intended to prevent its relative rotation.

In its back area, the metallic spiral has a reinforcement with a transverse pin that is guided with its ends in some longitudinal openings defined in the tubular part.

The metallic spiral may have an opening with a diameter significantly greater than that of the pin fastening it, in order to permit a lateral mobility when it is released from the tubular body through which it passes.

The metallic spiral has a leading portion permanently protruding through the leading end of the tubular part, allowing its introduction in the cork on rotating the corkscrew once the tubular body mouth is supported over the bottle.

The metallic spiral tends to be displaced toward the back area of the tubular part by the action of a spring that is resiliently deformable as said metallic spiral penetrates in the cork.

At the sides of the longitudinal openings, the internal tubular part has graduated scales permitting to know the penetration of the metallic spiral in the cork, depending on the position of the pin of the metallic spiral. In this way, the metallic spiral is prevented from crossing the entire cork.

In order to facilitate cork extraction, this corkscrew has a foldable lateral lever associated to the back end of the intermediate part. Over the intermediate area of this lever, a blade for the crown cork lifting of bottles and an arm which has to be detached from the internal surface of said part by the action of a torsion spring, are fitted by means of a common rotation shaft.

The purpose of this lever is to lean with its end over a teething defined in the lateral surface of the tubular body, determining the elevation of the upper end of the lever and hence, the internal tubular part, each time the lever is pressed towards the lateral surface of the external tubular body.

When pressing and releasing the lever repeatedly, the arm leans on the successive teeth of the tubular body until achieving total removal of the cork.

Laterally, the tubular body has means permitting the lever to be retained in the folded or closed position when not being used. The tubular body also has a lateral tooth to remove crown type corks.

According to the invention, the back end of the internal tubular part is closed by means of a cigar cutter, which moreover acts as a joining component between said part and the aforementioned foldable lever.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
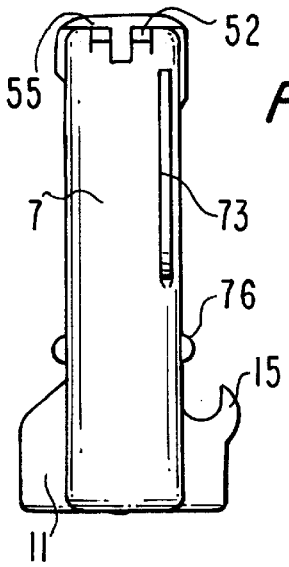
FIG. 1 is a view showing a profile view of the corkscrew in accordance with the present inventor, not in use.
Figure 3:
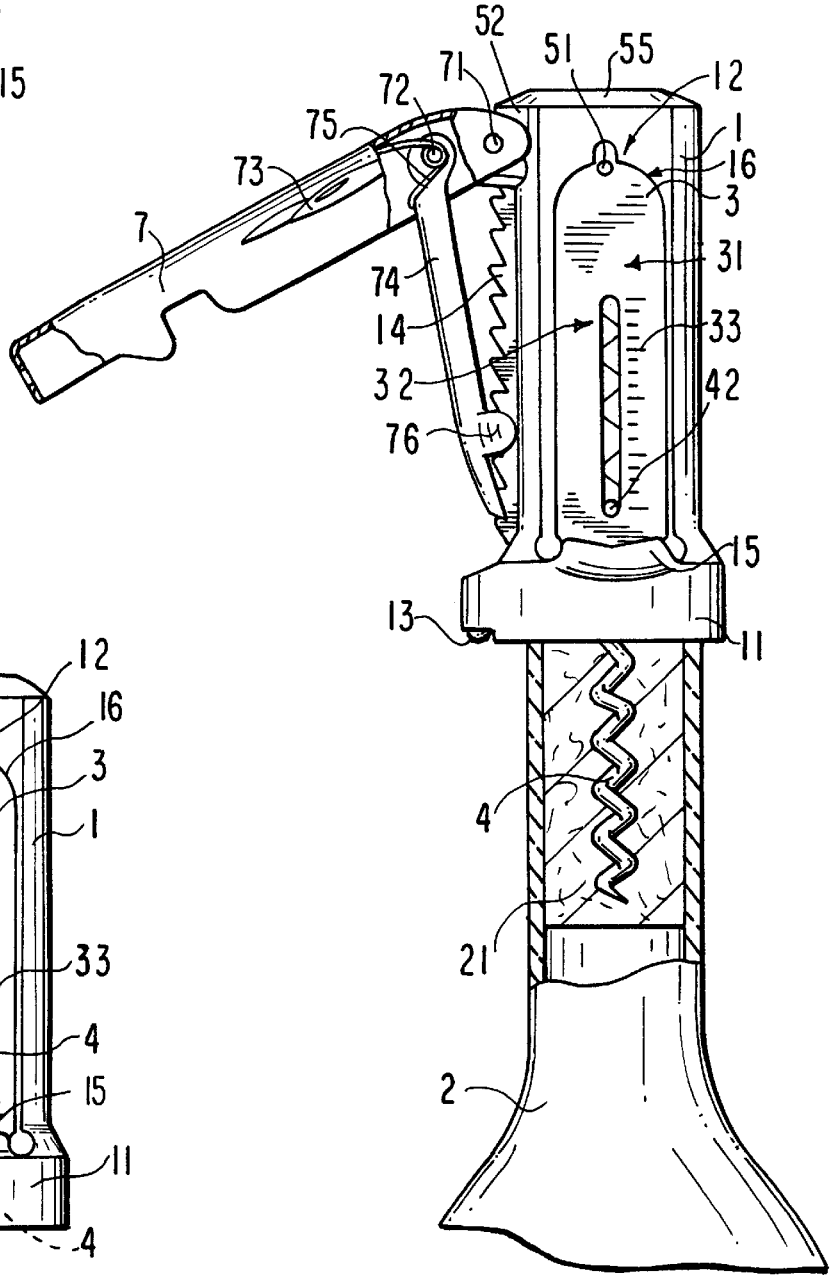
FIG. 3 is a view showing an elevation of the corkscrew in accordance with the present inventor, in which the metallic spiral may be seen, introduced in the cork to be removed and the lateral lever released from the hooking means of the tubular body. In this figure, the lever has been partially sectioned in order to facilitate the observation of the torsion spring acting over the former and over the arm associated to fit.
Figure 2:
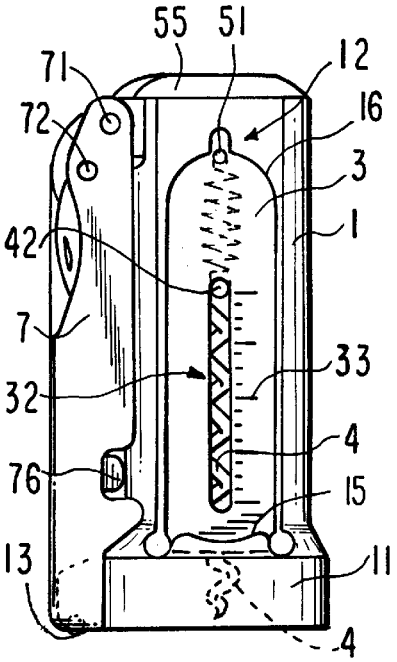
FIG. 2 is a view showing an elevation of the corkscrew in accordance with the present inventor, of the previous figure.
Figure 4:
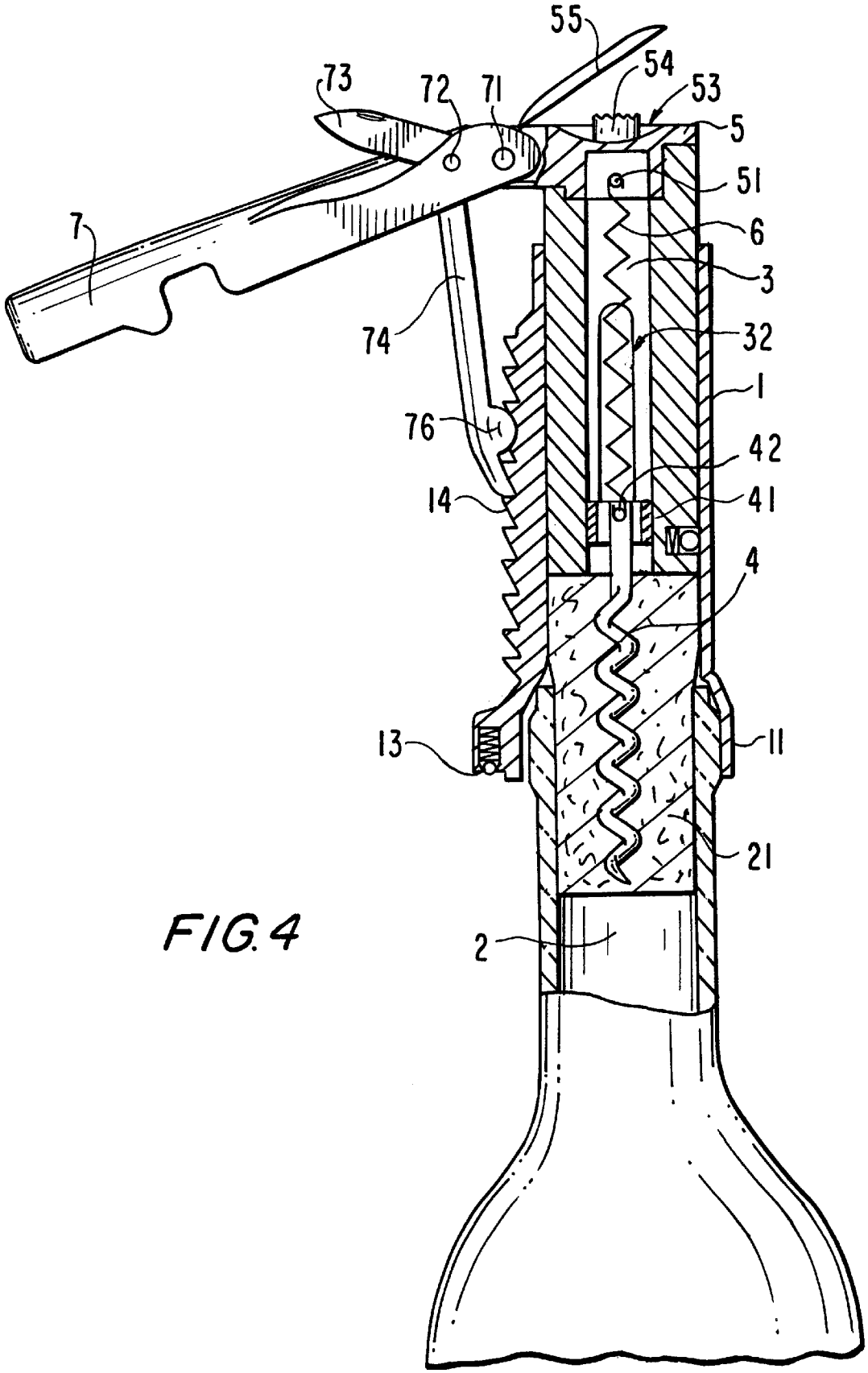
FIG. 4 is a view showing an elevation of the corkscrew in accordance stage of cork extraction.
Figure 5:
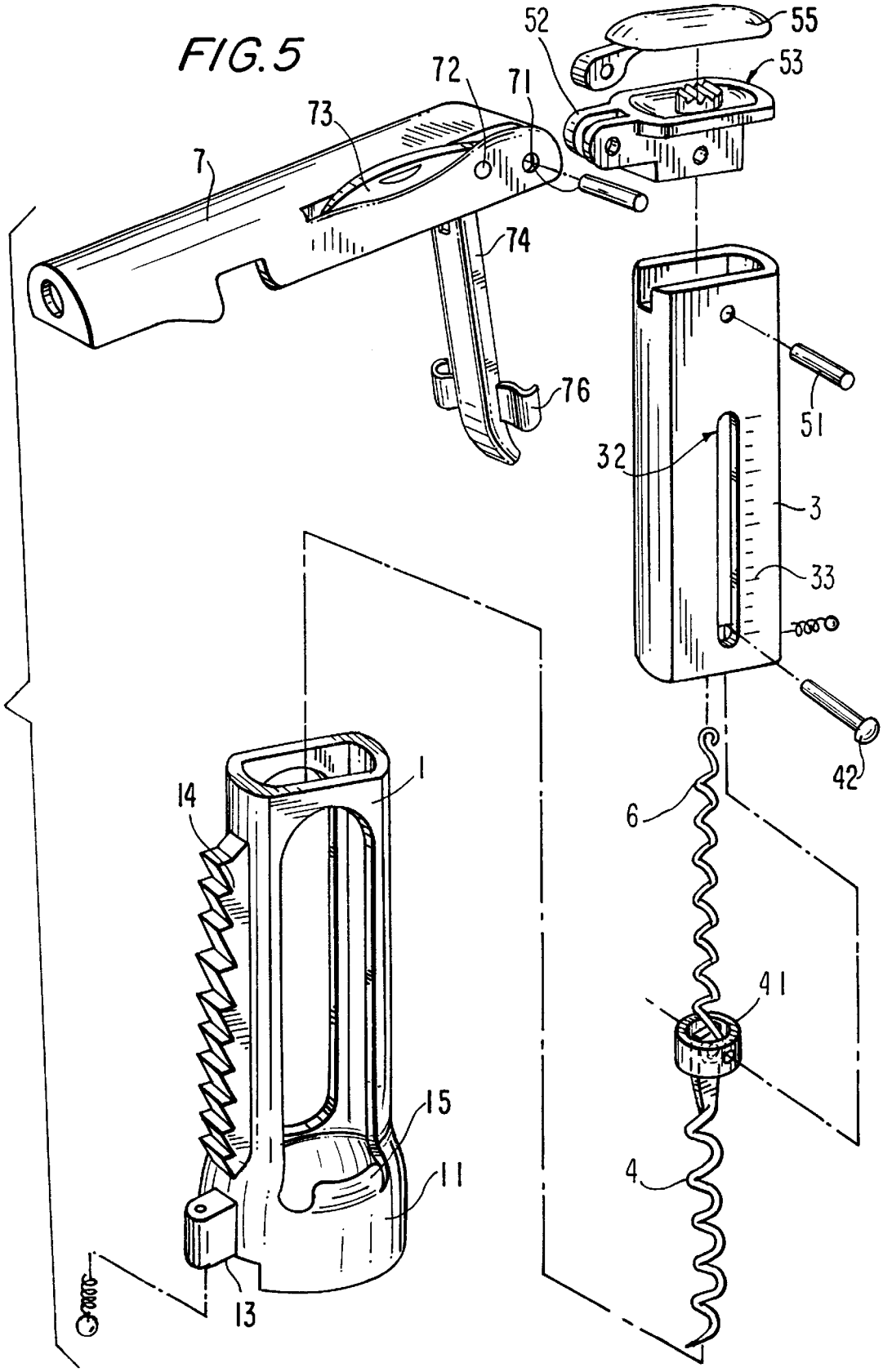
FIG. 5 is an exploded view of the corkscrew in accordance with the present invention.

As may be seen in the drawings, the improved corkscrew object in accordance with the present invention has a tubular body 1 provided with a mouth 11 intended to be supported over the bottle to be uncorked. Inside said tubular body a tubular part 3 is housed, in which a metallic spiral 4 is fitted.

Both the tubular body 1 and the tubular part 3 laterally have plane surfaces 12 and 31 intended to prevent the rotation of the tubular part 3 with respect to the body 1. The tubular part 3 is closed at the back end by means of a cigar cutter 5 fixed to the tubular part 3 by means of a pin 51.

The metallic spiral 4 has a reinforcement 41 at its back end, formed for example as a ring and provided with a transverse pin 42 whose ends protrude through diametrically opposite longitudinal openings 32 defined in the tubular part 3. The metallic spiral 1 has a leading portion that permanently protrudes from the rear end of the tubular part 3.

The metallic spiral 4 may be moved longitudinally through the inside of the tubular part 3. Its run is limited by the contact of the pin 42 with the forward and back ends of the openings 32. The metallic spiral 4 tends to be moved towards the back area of the tubular part 3 by the action of a spring 6 whose ends are hooked to the pin 42 and the pin 51.

The displaceable assembly of the metallic spiral 4 over the tubular part 3 permits that once the mouth 11 of the tubular body is supported over the bottle 2 the metallic spiral 4 gradually penetrates in the cork 21 as the corkscrew rotates.

The tubular part 3 has a graduated scale 33 in the sides of the openings 32, allowing to know the penetration of the metallic spiral in the cork 21 according to the position of the pin 42.

As the metallic spiral 4 is introduced in the cork 21, the former is displaced along the tubular part 3, being guided by the pin 42 in the openings 32 and overcoming the resistance of the spring 6. For moving of the tubular part 3, a foldable lever 7 is fitted by means of a shaft 71 over lateral lugs 52 formed for such a purpose in the cigar cutter 5. The lever 7 is arranged at one side of the tubular body 1 and has preferably a "U" section.

An external blade 73 to lift crown corks from bottles and an internal arm 74 intended to be separated from the internal surface of the foldable lever by the action of a torsion spring 75 fitted over the shaft 72, are fitted over the intermediate area of the lever 7 by means of a common rotational shaft 72.

The lever 7 may be kept attached to the tubular body 1 under the action of a button 13. The button 13 is housed in an opening of the tubular body 1 and can be spring-biased outwardly to hold the lever 7 in its closed position.

The tubular body is provided laterally with a toothing 14, over which the arm 74 actuated by the lever 7 can move step-by-step over its teeth in order to remove the cork 21. Preferably, the toothing 14 is formed as an oblique toothing.

The corkscrew in accordance with the present invention operates in the following manner.

The spiral 4 is introduced in the cork 21 by means of rotation of the corkscrew. Then, the button 13 is pressed inwardly, and the spring 75 opens the released lever 7. The free end of the arm 74 is placed over the toothing 14.

Then the lever 7 is folded against lateral surface of the body 1, and the lower arm of the arms 74 is supported over the toothing 14, so that thereby the upper end of the lever 7 and therefore the tubular part 3 make an ascending movement of a predetermined length.

When the lever 7 is released, it returns to the opening position by means of the spring 75 and the end of the arms 74 is interlocked in the toothing 14, but at a greater height with respect to the previous position. Therefore, by successively actuating the lever 7, the arm 74 moves the tubular part 3 upwardly and therefore moves the spiral 4 upwardly so as to remove the cork 21.

Cork removal is possible due to the pushing of the lower ends of the lateral openings 32 of the tubular part 3 over the ends of the pin 42 of the metallic spiral.

As may be observed in the drawings, the corkscrew has some structural features, such as a formation in the tubular body 1 shaped as a lateral tooth 15 for the removal of crown type corks. The tooth 15 is arranged in the base of the mouth 11.

The contact of the ends of the pin 42 with the back end of windows 16 of the tubular body 1 prevents the release of the tubular part 3 by the back end of the body 1.

The arm 74 has lateral tabs 76 facilitating its grip to release it from the toothing 14 once the cork 21 has been removed and folding it towards the inside of the lever 7.

As may be seen in the figures, the cigar cutter 5 has a concavity 53 in its back end, and a tubular appendix 54 extends from the concavity and has an end with a saw edge profile. The cigar cutter 5 also includes a foldable closing cover 55.

It is not considered it necessary to extend this specification any more for any person skilled in the art to understand the scope of the invention and the advantages derived from it. The terms in which this specification has been drafted should always be interpreted in the widest sense and not limited in any way.

The materials, shape, size and arrangement of the components may be varied provided this does not support an alteration of the basic features of the invention which are limited below.

It will be understood that each of the elements described above, or two or more together, may also find a useful application in other types of constructions differing from the types described above.

While the invention has been illustrated and described as embodied in corkscrew, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A corkscrew, comprising an external tubular body having a mouth forming a support over a bottle; a spiral introducible into a cork when rotating the corkscrew; support means for supporting said spiral; said support means including a tubular part housed in said external tubular body so as to be longitudinally displaceable and actuating means for raising said spiral and removing the cork, said actuating means including a toothing provided on said tubular body, an arm having a lower end engageable with and disengageable from said toothing and an upper end, and a lever pivotably connected with said tubular body and also pivotably connected with said upper end of said arm and pivotable toward and away from said tubular body, so as to provide step-by-step an engagement of said lower end of said arm with said toothing, a disengagement of said lower arm with said toothing, and a subsequent engagement of said lower end of said arm from said toothing at a greater height to impart an ascending movement to said support means and thereby to said spiral for removing the cork.

2. A corkscrew as defined in claim 1, wherein said toothing is formed as an oblique toothing with oblique teeth.

3. A corkscrew as defined in claim 1, wherein said tubular part has an intermediate area provided with two diametrically opposite longitudinal openings.

4. A corkscrew as defined in claim 3, wherein said spiral has a back end provided with a reinforcement having a transverse pin with ends guided in said openings of said tubular part.

5. A corkscrew as defined in claim 1; and further comprising a cigar cutter closing a back end of said tubular part and provided with a foldable cover; and further comprising a transverse pin fixing said cigar cutter to said tubular part.

6. A corkscrew as defined in claim 5, wherein said cigar cutter has lateral lugs, said foldable cover being hinged to said lateral lugs.

7. A corkscrew as defined in claim 1; and further comprising a blade provided on said lever for lifting crown corks from bottles.

8. A corkscrew as defined in claim 1; and further comprising a spring which biases said lever to an open position away from said tubular body.

9. A corkscrew as defined in claim 1; and further comprising a spring located inside said tubular part and acting on said spiral so as to displace said spiral toward a back end of said tubular body.

10. A corkscrew as defined in claim 4, wherein said ends of said pin protrude from said openings of said tubular part and are guided during a longitudinal displacement of said spiral in said longitudinal openings.

11. A corkscrew as defined in claim 4, wherein said ends of said pin are contactable with ends of said openings so as to determine a longitudinal displacement of said spiral relative to said tubular part.

12. A corkscrew as defined in claim 4, wherein said openings have sides provided with graduated scales indicating a displacement of the spiral in the cork according to a position of said pin.

13. A corkscrew as defined in claim 1, wherein said spiral has an end portion permanently protruding beyond a leading part of said tubular part so as to permit its introduction into the cork.

14. A corkscrew as defined in claim 1, wherein said tubular body laterally has means for retaining said lever in a closed position when not in use.

15. A corkscrew as defined in claim 14, wherein said means for retaining include a spring-biased button.

16. A corkscrew as defined in claim 4, wherein said spiral has a hole through which said pin passes.

* * * * *